US005985301A

United States Patent [19]

Nakamura et al.

[11] Patent Number: 5,985,301

[45] Date of Patent: Nov. 16, 1999

[54] ANTIBACTERIAL CELLULOSE FIBER AND PRODUCTION PROCESS THEREOF

[75] Inventors: Kenji Nakamura; Koji Nakamura, both of Osaka, Japan

[73] Assignees: Kenji Nakamura; Koji Nakamura, both of Osaka, Japan

[21] Appl. No.: 09/022,101

[22] Filed: Feb. 11, 1998

[30] Foreign Application Priority Data

Sep. 30, 1997 [JP] Japan ..... 9-281145

[51] Int. Cl.[6] ..... A01N 25/10

[52] U.S. Cl. ..... 424/404; 424/405; 424/413; 424/421; 424/618; 574/495; 574/611; 574/644

[58] Field of Search ..... 510/445; 424/404, 424/405, 407, 411, 412, 413, 414, 415, 421, 618; 574/495, 611, 644; 442/123

[56] References Cited

U.S. PATENT DOCUMENTS

| | | | |
|---|---|---|---|
| 3,769,060 | 10/1973 | Ida et al. | 117/37 R |
| 3,940,482 | 2/1976 | Grand | 424/245 |
| 4,959,268 | 9/1990 | Hagiwara et al. | 428/403 |
| 5,709,870 | 1/1998 | Yoshimura et al. | 424/404 |

*Primary Examiner*—Neil S. Levy

*Attorney, Agent, or Firm*—Konbbe, Martens, Olson & Bear, LLP

[57] ABSTRACT

A production process of cellulose fiber is characterized in that tertiary amine N-oxide is used as a solvent for pulp, and a silver-based antibacterial agent and optionally magnetized mineral ore powder are added, followed by solvent-spinning. The cellulose fiber exhibits an excellent long lasting antibacterial effect and serves preferably as medical products such as bandage, gauze, and surgical robes.

4 Claims, No Drawings

ANTIBACTERIAL CELLULOSE FIBER AND PRODUCTION PROCESS THEREOF

BACKGROUND OF THE INVENTION

This invention relates to a cellulose fiber exhibiting excellent antibacterial effects and a production process thereof.

From the viewpoints of a tendency toward cleanliness as a social phenomenon and a demand for sophisticated medical technology, antibacterial materials have attracted attention, and they have been important in, for example, the household field and the medical field.

Among these, textile goods are widely used in everyday use clothing and medical materials, and there is a great demand for fiber materials having antibacterial effects.

In the above-mentioned milieu, research and developments of fiber materials having antibacterial effects have become activated. For example, reported are a disinfectant polymer composition comprising a zeolite onto which metal ions are fixed (Japanese Patent Laid-open No. 59-133235), disinfectant fiber comprising iodine in an amount effective to exhibit disinfectant effects (Japanese Patent National Publication No. 61-500500), a resin composition comprising a combination of antibacterial zeolite and a discoloration-preventing agent (Japanese Patent Laid-open No. 63-265958), and an antibacterial acrylic fiber comprising a zeolite onto which metal ions are fixed. In particular, an antibacterial fiber product using a silver-based antibacterial agent and hydrogen peroxide (Japanese Patent Laid-open No. 7-109672), a fiber using a silver-based antibacterial agent and a particular aromatic compound for preventing coloring (Japanese Patent Laid-open No. 8-325844), and a synthetic fiber having a two-layer structure using a silver-based antibacterial agent (Japanese Patent Laid-open No. 9-87928) attract attention.

As described above, various fiber materials having characteristics of antibacterial effects are known, and a heavy metal-based inorganic antibacterial agent is primarily used as an antibacterial agent, and especially, a silver-based inorganic antibacterial agent is widely used. In general, a silver-based antibacterial agent has advantages, such as a high degree of safety to humans, antibacterial effects on various bacteria, a long-term duration of antibacterial effects, and excellent thermal resistance. However, there are problems in that uniform incorporation into a fiber is difficult in many cases, yarns are likely to be snapped during a spinning process, the texture of a fiber surface deteriorates, and the strength of the fiber is decreased.

As a host fiber material, synthetic fiber is mostly used. Using synthetic fiber such as polyester, polyamide, and polypropylene, a fiber containing a silver-based antibacterial agent is produced by melt-spinning after a silver-based antibacterial agent is added to molten resin or by melt-spinning of master pellets of synthetic resin to which a silver-based antibacterial agent is added. Such antibacterial fibers are widely used in fiber products such as non-weave textile, cloth, and filters, and some of them are used in medical products. However, they are not satisfactory products due to problems in moisture and water absorbency.

On the other hand, a natural fiber such as cotton does not exhibit sufficient antibacterial effects due to its constituent components. Further, a cellulose fiber such as rayon cannot possess antibacterial effects because chemical components used in the viscose production process decompose silver-based antibacterial agents. By using a binder, it is possible to fix a silver-based antibacterial agent on the surface of a cellulose fiber such as rayon. However, due to the binder, a texture of the fiber and moisture absorbency greatly deteriorate, and washing durability is poor, i.e., very little practical use is realized.

Cellulose fiber has been known as artificial fiber for some time, and had been manufactured and used widely until synthetic fiber was developed. In recent years, demand for cellulose fiber has been declined due to all-purpose characteristics of synthetic fiber, and cellulose fiber has been ignored. However, recently, cellulose fiber has been attractive as clothing material due to its natural texture and unusual functions.

Cellulose fiber itself such as cellulose fiber and cotton fiber is most suitable for surgical operations and medical treatment in view of its excellent moisture absorbency, water absorbency, and flexibility. Recently, as a demand increases for prevention of bacterial infection in the affected body part and further prevention of internal infection such as MRSA in a hospital, characteristics of fiber material for surgical robes and bandages become more important. However, as described above, cotton fiber does not exhibit sufficient antibacterial effects since cotton is a natural material itself and its constituent components interfere with antibacterial effects. On the other hand, synthetic fiber possessing antibacterial effects does not have moisture and water absorbency, and thus are not suitable for medical use, and cannot satisfy the requirements for medical products. Accordingly, a demand for imparting antibacterial effects to cellulose fiber becomes intensifies.

SUMMARY OF THE INVENTION

An objective of the present invention is to realize an excellent antibacterial function in a fiber having practical durability without lessening other functions such as textural appearance of fiber, moisture absorbency, and strength, by applying an antibacterial function to cellulose fiber and uniformly incorporating an antibacterial agent thereinto. Cellulose fiber is more attractive as clothing material due to its natural fiber texture and unique functions, and is increasingly important as a fiber material for medical use such as surgical robes and bandages.

In view of the above problems in conventional technology and the above-mentioned demands, the present inventors have conducted intensive research and development in order to impart antibacterial functions to cellulose fiber. As a result, the problems have been solved by using a recently developed novel production process of cellulose fiber, thereby completing the present invention.

That is, the present invention is a fiber and a production process thereof, characterized by the following features (1) through (10), wherein the basic structure is to incorporate a silver-based antibacterial agent into a cellulose fiber obtained by solvent-spinning wherein pulp is dissolved in an amine oxide-based solvent:

(1) An antibacterial cellulose fiber obtained by solvent-spinning wherein tertiary amine N-oxide is used as a solvent for pulp, said cellulose fiber containing a silver-based antibacterial agent.

(2) An antibacterial cellulose fiber containing a silver-based antibacterial agent in an amount of 0.1%–5.0% by weight.

(3) An antibacterial cellulose fiber obtained by solvent-spinning wherein tertiary amine N-oxide is used as a solvent for pulp, said fiber comprising a silver-based antibacterial agent and magnetized mineral ore powder.

(4) An antibacterial cellulose fiber obtained by solvent-spinning wherein tertiary amine N-oxide is used as a solvent for pulp, said fiber comprising a silver-based antibacterial agent in an amount of 0.1%–5.0% by weight and magnetized mineral ore powder in an amount of 0.1%–5.0% by weight.

(5) A production process of an antibacterial cellulose fiber comprising a solvent-spinning method using a silver-based antibacterial agent which is incorporated into a dope wherein pulp is dissolved in tertiary amine.

(6) A production process of an antibacterial cellulose fiber containing a silver-based antibacterial agent in an amount of 0.1%–5.0% by weight.

(7) A production process of an antibacterial cellulose fiber comprising a solvent-spinning method using a silver-based antibacterial agent and magnetized mineral ore powder which are incorporated into a dope wherein pulp is dissolved in tertiary amine.

(8) A production process of an antibacterial cellulose fiber comprising a silver-based antibacterial agent in an amount of 0.1%–5.0% by weight and magnetized mineral ore powder in an amount of 0.1%–5.0% by weight.

(9) An antibacterial cellulose fiber and a production process thereof, wherein the silver-based antibacterial agent is at least one selected from the group consisting of silver zeolite, silver zirconium phosphate, silver calcium phosphate, and silver-soluble glass.

(10) An antibacterial cellulose fiber and a production process thereof, wherein the magnetized mineral ore powder is obtained by magnetizing at least one selected from the group consisting of feldspar, silica, and clayey ceramic.

According to the present invention, by using a rayon pulp manufactured by a known production process of cellulose fiber in combination with a silver-based antibacterial agent, an antibacterial cellulose fiber having practical use has been surprisingly obtained for the first time in the world. This fiber can effectively serve as antibacterial fiber in products for medical use. In particular, it is effective in fiber products for medical use such as bandages, gauze, and cotton wool as well as underwear, bedclothes, interior furnishings, surgical robes, and white coats. Further, as a general clothing material complying with society's tendency toward cleanliness, the importance of the fiber increases more and more.

The antibacterial effect of the cellulose fiber obtained in the present invention is excellent as compared with conventional products, and its duration is especially remarkable. Further, generally, the fiber possess desirable properties required for fiber, especially its texture, strength when moisturized. Its processing characteristics are excellent, and the production process thereof exhibits advantages, i.e., it is simple and economical.

DETAILED DESCRIPTION OF THE PREFERRED EMBODIMENT

The constituent features of the present invention will be explained in detail below.

The present invention is to obtain an antibacterial cellulose fiber by using a production process of a cellulose fiber by solvent-spinning using tertiary amine N-oxide as a solvent for pulp, wherein a silver-based antibacterial agent or magnetized mineral ore powder is used. As described above, it is impossible to impart antibacterial property to cellulose fiber by using a silver-based antibacterial agent, because chemicals used in the production process of viscose decompose the silver-based antibacterial agent. It is possible to fix a silver-based antibacterial agent onto the surface of cellulose fiber by using a binder; however, this is in practice impossible because, due to the binder, the texture of the fiber and moisture absorbency deteriorate and washing durability is poor. Further, the use of a binder is prohibitive in fiber materials for medical use in view of problems such as allergies, i.e., a method to fix a silver-based antibacterial agent by using a binder in a subsequent separate process is not appropriate. A production process of cellulose fiber relies worldwide on viscose rayon methods, and a cellulose fiber containing a silver-based antibacterial agent is not known. Incidentally, an antibacterial cellulose fiber cannot be manufactured by capper ammonia methods either, because a silver-based antibacterial agent is decomposed by a highly concentrated alkali.

In a viscose rayon method typifying a production process of cellulose fiber, pulp is dissolved in caustic soda to produce alkali cellulose, which is reacted with carbon disulfide to produce cellulose sodium xanthate, which is again dissolved in caustic soda to produce viscose, which is then subjected to neutralization reaction with dilute sulfuric acid to solidify it, thereby reproducing as a cellulose fiber. Recently, an epoch-making method has been developed as a production process of cellulose fiber and has attracted attention. This method breaks technological common sense of chemical methods such as conventional viscose rayon methods. This method can be defined as a physical method without using chemical reactions, characterized by the use of a specific solvent to dissolve pulp, wherein pulp is dissolved in amine oxide-based solvent, followed by solvent-spinning.

This method is disclosed in Japanese Patent Publication No. 57-11566, and basically comprises the steps of (1) mixing dissolved pulp and amine oxide-based solvent, and forming a transparent viscose solution by passing the mixture through a continuous dissolving apparatus; (2) filtering the resulting solution, conducting spinning in a dilute aqueous solution of amine oxide, and causing solidification in the form of cellulose fiber; (3) then washing and drying the fiber to produce stable fiber or continuous tow fiber. This method is essentially different from conventional production processes of cellulose fiber in that pulp is simply dissolved in a specific solvent and subjected to spinning. This is a closed system, and the solvent is recycled, i.e., a simple and non-polluting method as compared with the conventional methods. Further, the resulting fiber has superior properties as compared with the conventional fibers, i.e., the fiber by this method has a nearly perfect circular cross section and a smooth surface structure, and further has excellent cohesion ability and processing ability resulting from the excellent cohesion ability. In addition, the molecular structure of cellulose is not broken down because the fiber is not denatured by chemical reactions, and the strength of the fiber is remarkably increased as compared with the conventional fibers, especially when it is moisturized or wet.

The present inventors have focused on this latest production process of cellulose fiber, and conceived applying thereto a method of imparting antibacterial functions by using conventional silver-based inorganic antibacterial agents, thereby making it surprisingly possible for the first time to produce a cellulose fiber having antibacterial functions. A cellulose fiber having antibacterial functions, which heretofore could not be manufactured, has been herein created by a novel concept, i.e., a combination of the latest production process of cellulose fiber and a silver-based antibacterial agent.

The present invention uses the above-mentioned latest production process of cellulose fiber, wherein pulp is dissolved in an amine oxide-based solvent, a silver-based antibacterial agent is added thereto, the mixture is subjected to spinning in a dilute aqueous solution of amine oxide, and solidified in the form of cellulose fiber.

As for pulp, ordinary pulp derived from, e.g., natural wood can be used. As for an amine oxide-based solvent, tertiary amine solvent can be used, such as N-methylmorpholine N-oxide, N,N-dimethylethanolamine N-oxide, N,N-dimethylbenzylamine N-oxide, N,N,N-triethylamine N-oxide, and dimethylcyclohexyl N-oxide. The solvent is aqueous, and normally contains 6%–21% water.

A silver-based antibacterial agent may be at least one selected from the group consisting of silver zeolite, silver zirconium phosphate, silver calcium phosphate, and silver soluble glass. The agent may be mixed in a cellulose solution in the form of slurry and in an amount of 0.1%–5.0%, preferably 0.5%–2.0%, by weight based on the weight of cellulose. When the amount is less than 0.1% by weight, antibacterial effects are poor, whereas when the amount is more than 5.0% by weight, the antibacterial effects remain the same but in some cases, spinning is made difficult and the quality of the fiber deteriorates. It has been discovered that, in order to increase antibacterial effects of a silver-based antibacterial agent, magnetized mineral ore powder can be added, causing synergistic effects. The magnetized mineral ore powder may be at least one selected from the group consisting of feldspar, silica, and clayey ceramic. The addition is preferably in the range of 0.1%–5.0%, preferably 0.5%–2.0%, by weight based on the weight of cellulose. When the addition is less than 0.1% by weight, the synergistic effects are poor, whereas when the addition is more than 5.0% by weight, the synergistic effects remain the same but in some cases, spinning is made difficult and the quality of the fiber deteriorates. Mineral ore powder may be pulverized powder having a particle size of 0.5–2.0 $\mu$m and magnetized to 2–10 gauss/gram using a magnetizing apparatus. By mixing magnetized minerals, moisture absorbed by the cellulose fiber becomes magnetized functional water, thereby enhancing antibacterial effects presumably by promoting the discharge of silver ions from the silver-based antibacterial agent.

EXAMPLES

As embodiments of the present invention, typical examples will be explained next. However, the present invention should not be limited thereto.

Example 1

8 kg of rayon pulp was dissolved in 12 kg of a solvent of N,N-dimethylcyclohexylamine N-oxide containing 11% of water in a nitrogen atmosphere at a temperature of 90° C. over a period of 70 minutes. 70 g of AJ10N (silver zeolite, Shinagawa Nenryo K. K.) was then dispersed in 1 kg of N,N-dimethylcyclohexylamine N-oxide to form a slurry, and mixed in the aforesaid solution. The mixture solution was extruded into water from a spinning mouthpiece for stable fiber, sufficiently washed with water to remove the solvent, and dried, thereby obtaining a single-yarn antibacterial cellulose fiber having a fineness of 2d. From the fiber, a stable fiber having a fiber length of 2 inches was obtained.

Using this antibacterial stable fiber, cotton wool was formed, and *Staphylokokkus aureus* were inoculated thereto at a concentration of $2\times10^6$/ml and cultured, followed by counting the number of the bacteria. As a result of counting the number of the bacteria after culturing for four hours, the number of the bacteria was reduced to $1\times10^2$/ml or less.

When conventional cotton wool was used, the number of the bacteria was increased to $6\times10^6$/ml after culturing for four hours in the same manner as above.

In contrast, the cotton wool according to the present invention was characterized by the long duration of the antibacterial effect, which was different from a temporal effect by sterilization.

Example 2

9 kg of rayon pulp was suspended in 40 kg of a solvent of N,N-dimethylethanolamine N-oxide containing 10% of water, and allowed to stand for 15 minutes at a temperature of 90° C. The mixture was then subjected to a reduced pressure of 43 mgHg at a temperature of 90° C. and stirred for 30 minutes to form a solution. 40 g of NOVALON (silver zirconium phosphate, Thoa Gosei Kagaku K. K.) and 40 g of magnetized fine mineral power was then dispersed in 1 kg of N,N-dimethylethanolamine N-oxide to form a slurry, and mixed in the aforesaid solution. The mixture solution was extruded into water from a spinning mouthpiece for stable fiber, sufficiently washed with water to remove the solvent, and dried, thereby obtaining a single-yarn antibacterial cellulose fiber having a fineness of 2d. From the fiber, a stable fiber having a fiber length of 2 inches was obtained.

Using this antibacterial stable fiber, a non-weave cloth with 40 g/m$^2$ matrix was produced and then a bandage was produced therefrom. *Staphylokokkus aureus* were inoculated onto the bandage at a concentration of $1.6\times10^4$/ml and cultured, followed by counting the number of the bacteria. As a result of counting the number of the bacteria after culturing for three hours, the number of the bacteria was reduced to $1\times10^2$/ml or less.

When a conventional bandage was used, the number of the bacteria was increased to $8.5\times10^5$/ml after culturing for three hours in the same manner as above.

When the bandage according to the present invention was applied on a burn wound, skin tissues recovered at approximately twice the normal speed, and very little keloid tissue formed.

Example 3

35 kg of rayon pulp was suspended in 180 kg of a solvent of N,N,N-triethylamine N-oxide containing 26% water and 10 kg of ethanol, and dissolved over a period of one hour at a temperature of 80° C. 150 g of AW10N (silver zeolite, Shinagawa Nenryo K. K.) and 100 g of magnetized fine mineral power was then dispersed in 8 kg of N,N,N-triethylamine N-oxide to form a slurry, and mixed in the aforesaid solution. The mixture solution was extruded into water from a spinning mouthpiece for stable fiber, sufficiently washed with water to remove the solvent, and dried, thereby obtaining a single-yarn antibacterial cellulose fiber having a fineness of 2d. From the fiber, a stable fiber having a fiber length of 2 inches was obtained. Using this antibacterial stable fiber, a gauze was produced.

The use of the gauze in an affected body part demonstrated not only preventing bacterial infection but also shortening the period for healing the affected body part with no secondary infection, i.e., excellent healing effects.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A process of producing an antibacterial fiber product, comprising the steps of:

(a) dissolving pulp in an amine oxide solution to obtain a cellulose solution;

(b) adding an inorganic antibacterial agent of silver in slurry to the cellulose solution in an amount of 0.1%–5.0% by weight based on the weight of the cellulose in the solution;

(c) spinning a cellulose fiber out of the cellulose solution into an aqueous solution by solvent-spinning; and (d) producing an antibacterial fiber product from the cellulose fiber.

2. A process according to claim 1, further comprising adding magnetized mineral ore powder to the cellulose solution in an amount of 0.1%–5.0% by weight based on the weight of the cellulose in the solution.

3. A process according to claim 1, wherein the amine oxide is selected from the group consisting of N-mehylmorpholine N-oxide, N,N-dimethylethanolamine N-oxide, N,N-dimethylbenzylamine N-oxide, N,N,N-triethylamine N-oxide, and dimethylcyclohexyl N-oxide.

4. A process according to claim 1, wherein the amine oxide solution contains 6%–21% water.

* * * * *